US006851482B2

(12) United States Patent
Dolan

(10) Patent No.: US 6,851,482 B2
(45) Date of Patent: Feb. 8, 2005

(54) SPRINKLER ASSEMBLY

(76) Inventor: Kevin Michael Dolan, 4 Wickhams Fancy, Canton, CT (US) 06019

( * ) Notice: Subject to any disclaimer, the term of this patent is extended or adjusted under 35 U.S.C. 154(b) by 180 days.

(21) Appl. No.: 09/985,039

(22) Filed: Nov. 1, 2001

(65) Prior Publication Data

US 2002/0050531 A1 May 2, 2002

Related U.S. Application Data

(60) Provisional application No. 60/245,441, filed on Nov. 2, 2000.

(51) Int. Cl.[7] ..... A62C 35/00

(52) U.S. Cl. ..... 169/16; 169/17; 169/37; 169/38; 239/498

(58) Field of Search ..... 169/16, 17, 37, 169/38; 239/498

(56) References Cited

U.S. PATENT DOCUMENTS

| | | | | |
|---|---|---|---|---|
| 3,734,191 | A | | 5/1973 | Johnson et al. |
| 3,911,940 | A | | 10/1975 | Johnson |
| 3,924,687 | A | | 12/1975 | Groos |
| 3,991,829 | A | | 11/1976 | Johnson |
| 4,128,128 | A | | 12/1978 | Mears |
| 4,258,795 | A | | 3/1981 | Hansen |
| 4,368,782 | A | | 1/1983 | Bray |
| 4,553,602 | A | | 11/1985 | Pieczykolan |
| 5,533,576 | A | | 7/1996 | Mears |
| 5,609,211 | A | * | 3/1997 | Meyer et al. ..... 169/37 |
| 5,967,240 | A | | 10/1999 | Ondracek |

* cited by examiner

*Primary Examiner*—Gene Mancene
*Assistant Examiner*—Thach H. Bui
(74) *Attorney, Agent, or Firm*—Nixon Peabody LLP; Tim L. Brackett, Jr.

(57) ABSTRACT

A sprinkler assembly for controlling a fire situation includes at least one fluid conduit defining a flow passage including an inlet for receiving a fluid from a fluid source and at least one outlet for discharging the fluid, and a dispensing mechanism such as an open or closed sprinkler head for distributing water to a selected location. A fluid control apparatus is provided including a valve assembly having a valve seal which is moveable between a closed position blocking fluid flow through the conduit and an open position causing fluid flow through the conduit. The fluid control apparatus further includes an actuating mechanism including a valve actuator which is operatively connected to the valve assembly for causing movement of the valve seal to the open position upon release of the sealing force. A sensing mechanism is operatively connected to the valve assembly, the sensing mechanism being thermodynamically responsive to at least one of heat, smoke, infrared radiation and ultraviolet radiation emitted by a heat source.

34 Claims, 8 Drawing Sheets

SPRINKLER ASSEMBLY

This Application claims the benefit of Provisional Application No. 60/245,441, filed Nov. 2, 2000.

BACKGROUND OF THE INVENTION

1. Field of the Invention

The present invention relates generally to a sprinkler assembly for controlling a fire situation.

2. Description of the Related Art

Conventional methods of extinguishing chemical reactions such as fire or flames include sprinkler systems. According to the standard for the Installation of Sprinkler Systems, NFPA 13, a sprinkler system is defined as an integrated system of underground and overhead piping designed in accordance with fire protection engineering standards. The installation includes one or more automatic water supplies. The portion of the sprinkler system above ground is a plurality of specially sized or hydraulically designed piping installed in a building, structure, or area, generally overhead, and to which sprinklers are attached in a systematic pattern. The valve controlling each system riser is located in the system riser or its supply piping. Each sprinkler system riser includes a device for actuating an alarm when the system is in operation. The system is usually activated by heat from a fire and discharges a fire-retardant substance such as water over the fire area.

The most common type of sprinkler system is a wet pipe sprinkler system. A wet pipe sprinkler system employs automatic sprinklers attached to a piping system containing water and connected to a water supply so that water discharges immediately from sprinklers opened by heat from a fire. This type of system is the simplest and most reliable. However, in areas where the sprinkler system, in whole or in part, is subject to freezing conditions, water cannot be maintained in the sprinkler system piping since it could freeze and compromise the integrity of the system.

The traditional way of providing fire sprinkler protection in these areas is by the use of an antifreeze system, dry pipe sprinkler system and/or dry sprinklers. Antifreeze systems are wet pipe assemblies that utilize an antifreeze solution in the piping system to prevent a freeze up of the sprinkler system. When one or more sprinklers is opened due to a fire situation, the antifreeze solution is discharged followed by water, which enters the system from a connected water supply. Because an antifreeze system is usually part of a wet pipe sprinkler system, it requires some form of separation from the wet pipe system to prevent the mixing of the antifreeze solution and the water. This is generally accomplished using a special valve and piping arrangement. The antifreeze solution must also be monitored periodically to ensure the proper mixture is maintained. Also, an antifreeze system is subject to regulation by state and local health and municipal water departments. These regulations have placed restrictions on the use of antifreeze systems to protect against contamination of public water supplies. All of these items have an impact on the cost effectiveness of using antifreeze systems, and thus, are disadvantageous.

A dry pipe sprinkler system is one in which water is prevented from entering the sprinkler system piping until a fire situation has occurred. A dry pipe sprinkler system includes a dry pipe valve which is installed between a water supply and piping of the sprinkler system. The sprinkler system side of the dry pipe valve is pressurized with a gas such as air or nitrogen. This pressure holds the dry pipe valve closed preventing water from entering the system.

When a sprinkler activates, the gas pressure drops in the sprinkler system. When the gas pressure drops to a level such that it can no longer hold the dry pipe valve closed, the valve opens and allows water to enter the entire piping system. When a sprinkler system is exposed only to local freezing conditions, such as a freezer, a dry sprinkler is typically used to provide fire protection to that area.

The typical construction of a dry sprinkler is a sprinkler head that is permanently mounted on the end of a length of pipe opposite the inlet end of the pipe. A fusible element or frangible glass bulb is located in the sprinkler frame and is in contact with a strut, rod or tube. The strut, rod or tube transfers the force required to hold in place a seal that is located at the inlet end of the pipe. The seal prevents water from entering the pipe until the sprinkler has operated. Some dry sprinkler designs utilize a pressurized gas filled pipe instead of a strut rod or tube to transfer the load to the seal inlet from the sprinkler head. In the event of a fire situation, the fusible element or frangible glass bulb activates, releasing the force holding the seal in place and allowing water to flow through the dry sprinkler pipe and out the sprinkler head.

When the dry sprinkler is installed into the sprinkler piping system, the sprinkler head of the dry sprinkler will be located inside the area where the freezing conditions will occur. The pipe, which makes up the length of the dry sprinkler, is kept dry by the seal located at the inlet of the dry sprinkler. This prevents the pipe from filling up with liquid and freezing. The inlet of the dry sprinkler is connected to the sprinkler piping system. The length of the dry sprinkler can vary depending on the location of the sprinkler system with respect to the location of the head of the sprinkler.

The benefits derived from using a conventional dry sprinkler is based essentially on an economical solution to fire protection of a local area that is subject to freezing conditions without the need for a complete dry pipe sprinkler system. The disadvantages of using a conventional dry sprinkler is that it varies in size and currently is made to order by a dry sprinkler manufacturer. The current manner of installing dry sprinklers is to initially measure the distance from the sprinkler piping system to the locations that the sprinklers will be employed. Subsequently, a list is made of the location and size of each dry sprinkler required for a given installation. An order for these dry sprinklers is then placed with a dry sprinkler manufacturer. Completion of the installation then waits for the manufacturer to produce and send them to the contractor. In essence, the process for installing conventional dry sprinklers is time consuming. In addition, unlike a wet pipe system, the length of a pipe nipple in a dry sprinkler cannot be adjusted in the field by the sprinkler fitter. If the contractor orders the wrong size or the manufacturer fabricates the wrong size, another order must be issued, which further delays the installation time.

An improved assembly and method is, therefore, desired for employing the controlled distribution of a fluid to a selected portion of a fluid distribution assembly that is not only simple, durable, reliable, but also provides effective sensing and extinguishing of fire within a selected zone as well as is economical to build, maintain and operate.

SUMMARY OF THE INVENTION

Accordingly, it is an object of the present invention to provide a high performance, economical and reliable sprinkler assembly for producing a controlled distribution of a fluid to a location such as a commercial structure or home dwelling.

Another object of the present invention is to provide a sprinkler assembly that may be custom built on site.

A further object of the present invention is to provide a sprinkler assembly having a plurality of dispensing mechanisms for use in dry, preaction, and preaction dry sprinkler applications.

Still another object of the present invention is to provide a sprinkler assembly suitable for location inside an area subject to either ambient or freezing temperatures.

Yet another object of the present invention is to provide a sprinkler assembly including a valve assembly that prevents fluid buildup on the valve seal if placed in a location subject to freezing temperatures.

Yet a further object of the present invention is to provide a sprinkler assembly including a valve assembly that prevents fluids from prematurely entering the valve chamber to seize the working parts of the valve assembly if placed in an area subject to freezing temperatures.

Still a further object of the present invention is to provide a sprinkler assembly that functions as an "ON" type assembly whereby the valve seal remains in an open position irrespective of a change in magnitude of heat emitted by the heat source once said valve seal moves into the open position.

Another object of the present invention is to provide a sprinkler assembly including a movable sensing mechanism that is adaptable for placement at a location for optimum thermodynamic sensitivity and accuracy in response to a fire situation.

Yet another object of the present invention is to provide a sprinkler assembly including at least one dispensing mechanism adapted for placement at a location of optimum fluid distribution.

It is still another object of the present invention is to provide a preaction sprinkler assembly including at least one dispensing mechanism equipped with a sealing mechanism separate from the valve seal mechanism.

Still a further object of the present invention is to provide a sprinkler assembly that may incorporate various pipe fittings to enable installation in structures that require the use of a combination of straight and bent piping.

Another object of the invention is to provide a sprinkler assembly including a valve assembly having a sealing force applied to a valve seal independent from a dispensing mechanism and a fluid conduit.

These, as well as other objects, are set forth in accordance with exemplary embodiments of the present invention, in which a sprinkler assembly, adaptable for a dry or preaction dry assembly, is provided for controlling a fire situation. The assembly includes at least one fluid conduit, such as a length of pipe, the conduit defining a flow passage including an inlet for receiving a fluid from a fluid source and at least one outlet for discharging the fluid. At least one dispensing mechanism, such as an open sprinkler head or an automatic sprinkler head is connected to the conduit for distributing water to a selected location such as a room or the like requiring protection from fire.

The sprinkler assembly also includes a fluid control apparatus including a valve assembly for controlling flow of the fluid through the conduit. The valve assembly includes a valve body defining a chamber having an inlet for receiving the fluid from a fluid source and an outlet for discharging the fluid to the conduit, and thus, the dispensing mechanism. A valve seal is positioned at the valve inlet upstream of the dispensing mechanism and conduit, the valve seal being moveable between a closed position blocking fluid flow through the chamber and an open position permitting or causing fluid flow through the conduit. As a result, the sprinkler assembly functions as an "ON" type assembly such that the valve seal cannot return to the closed position once in the open position regardless of any change in magnitude of the fire situation.

The valve seal is positioned in the closed position by a sealing force that maintains the valve seal at the valve inlet to prevent the flow of fluid to the conduit. Positioned downstream of the valve inlet and valve seal is a valve operator that applies a sealing force to the valve seal independent of both the conduit and the dispensing mechanism. Accordingly, unlike many conventional dry sprinkler assemblies, which require sealing forces that are dependent upon a sprinkler head or nozzle and a length of pipe connected thereto, during installation of the assembly, the conduit can be custom fit at any appropriate length in the field. This is advantageous in reducing the overall installation costs and the time required for installation.

The spatial configuration between the valve inlet and the valve seal prevents fluids and corrosion from entering the valve chamber and impeding activation of the valve seal, and thus, fluid flow upon activation of the valve seal. Such a configuration is also advantageous in preventing fluid buildup on the seal which causes freezing and/or locking of the seal in the closed position if placed in a location subject to freezing temperatures. The sealing force placed on the valve seal is advantageous since it prevents premature fluid entry into the valve chamber which causes seizure of the working parts of the valve assembly if subject to freezing temperatures. Another advantageous feature of the invention is that the valve seal is adapted to remain in the open position irrespective of a magnitude of heat emitted by the heat source.

The fluid control apparatus further includes an actuating mechanism having a valve actuator which is operatively connected to the valve assembly for causing movement of the valve seal to the open position upon release of the sealing force. The actuator includes a housing having a chamber and an inlet adapted to receive a fluid, preferably, a gas such as air, nitrogen or like inert gases. The actuating mechanism also includes a compliant diaphragm, a piston element positioned adjacent to the diaphragm, and a locking member including an elongated pin member.

The diaphragm is adapted for synchronous movement with the piston element in response to fluid pressure received from the fluid source, the fluid pressure being associated with the heat emitted by a heat source. The elongated pin member is adapted for movement relative to the valve body between a locked position preventing the rotational and axial movement of the strut and an unlocked position permitting the rotational and axial movement of the strut to thereby release the sealing force from the valve seal. Accordingly, the pin member, once in the locked position, maintains the sealing force on the valve seal while the placement of the pin member in the unlocked position causes the release of the sealing force by the valve seal.

The piston is disposed in the chamber for synchronous movement with the diaphragm between a first position maintaining the pin member in the locked position and a second position causing or permitting movement of the pin member into the unlocked position. A biasing mechanism is disposed in the chamber for biasing the compliant diaphragm and the piston in the first position, and thus, the pin member in the locked position.

The assembly also includes a sensing mechanism operatively connected to the valve assembly. In accordance with the invention, the sensing mechanism is in fluid communication and operatively connected to the actuating mechanism and is thermodynamically responsive to at least one of heat, smoke, infrared radiation and ultraviolet radiation emitted by a heat source, i.e., the source of the fire. The sensing mechanism includes a housing adapted to be filled with a gas that expands in response to heat emitted by the heat source. In accordance with the invention, the gas for placement into the housing may comprise at least one of air, nitrogen or like inert gases or combinations of gases. The housing serves as a heat sink or collector, and thus, is adapted to transfer to the diaphragm a fluid pressure associated with the heat emitted by the heat source.

A coupling member is provided for establishing a connection, such as a fluid flow path, between the sensing mechanism and the actuating mechanism. Preferably, the coupling member includes a flexible element such as a length of tubing that permits the sensing mechanism to be placed at a position for optimum thermodynamic response. In this regard, the coupling member may have a length that permits the sensing mechanism to be located at any position that permits optimum thermodynamic sensitivity during a fire situation. It is also preferable that the coupling member is composed of a flexible material that is capable of withstanding an environment subject to freezing temperatures and a high range of temperatures in which the sensing mechanism will be exposed during a fire situation.

Another embodiment in accordance with the invention is directed to a dry sprinkler assembly having the aforementioned features, but which includes a plurality of conduits and sprinkler heads for installation in rooms of large size or rooms used for storing important documents and/or items. Accordingly, such a assembly incorporates the use of one or more various pipe fittings.

Yet another embodiment in accordance with the invention is directed to a dry sprinkler assembly having the aforementioned features, but which includes an automatic or open sprinkler head which is directly connected to a fluid control assembly. Such a design is applicable in situations that have limited or no ceiling space in which to place a length of piping.

Still another embodiment in accordance with the invention is directed to a sprinkler assembly including an integral dispensing and valve mechanism in fluid communication with a fluid source for dispensing a fluid. The dispensing and valve mechanism includes a dispensing and valve body having a valve body section and a dispensing body section integrally connected. The valve body section includes an inlet for receiving the fluid from the fluid source while the dispensing body section includes an outlet for dispensing the fluid. The dispensing and valve mechanism also includes a valve positioned in the valve body section for controlling flow of the fluid therethrough. The valve includes a valve element moveable between a closed position blocking fluid flow through the dispensing body section and an open position causing fluid flow through the dispensing body section.

The present invention will now be further described by reference to the following drawings.

DETAILED DESCRIPTION OF THE INVENTION

Figure 1:
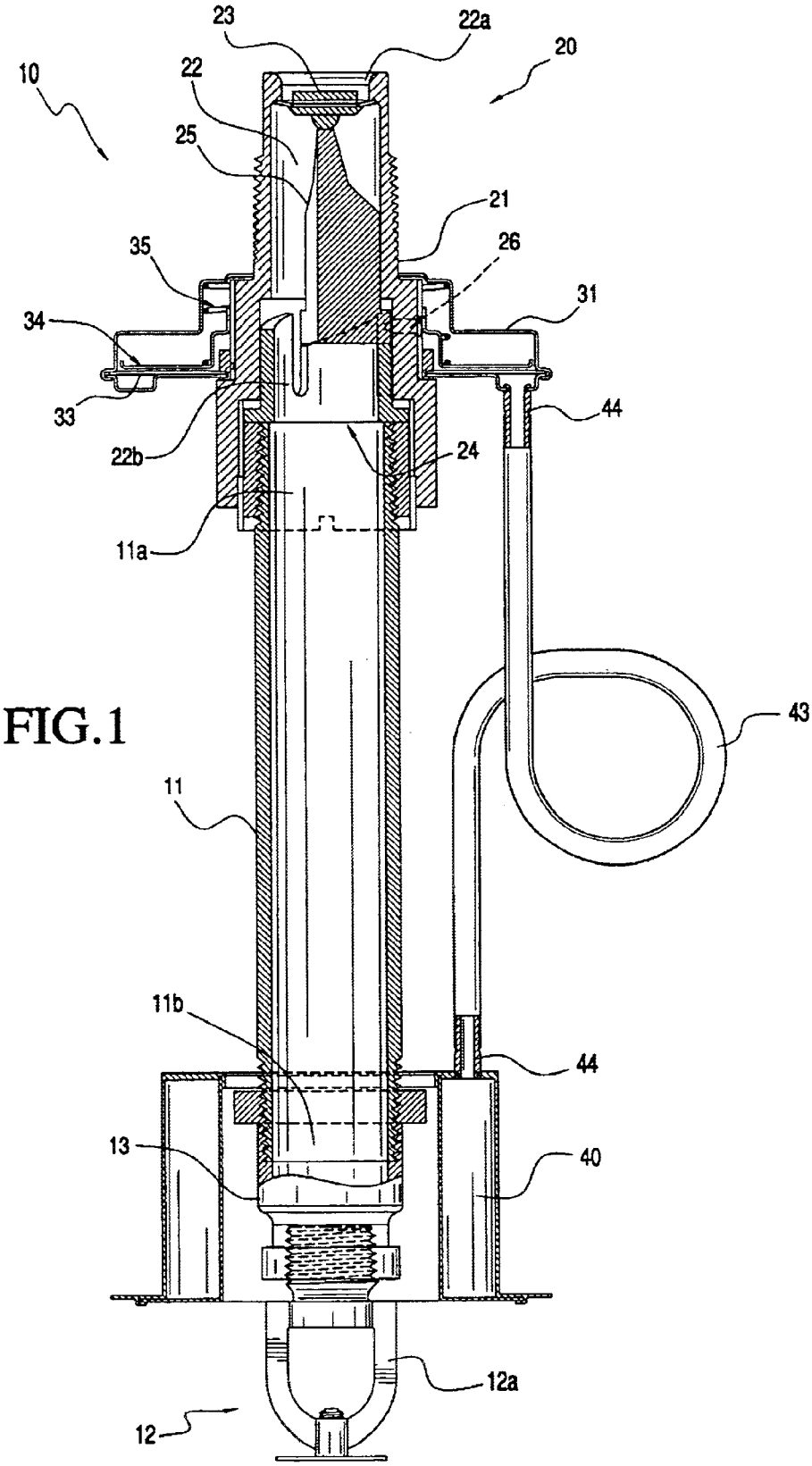
FIG. 1 is a planar view of a dry sprinkler assembly in accordance with a first embodiment of the present invention.

Referring now to the drawings and, more particularly, to FIG. 1, which shows in accordance with a first embodiment of the invention a dry sprinkler assembly 10 for controlling a fire situation. The assembly 10 includes at least one fluid conduit 11, such as a length of pipe, the conduit 11 defining a flow passage including an inlet 11*a* for receiving a fluid from a fluid source and an outlet 11*b* for discharging the fluid. The assembly 10 also includes at least one dispensing mechanism 12, such as an open sprinkler head 12*a* which discharges a predetermined spray pattern of fluid to a selected location such as a room or space that requires protection from a fire situation.

Figure 2:
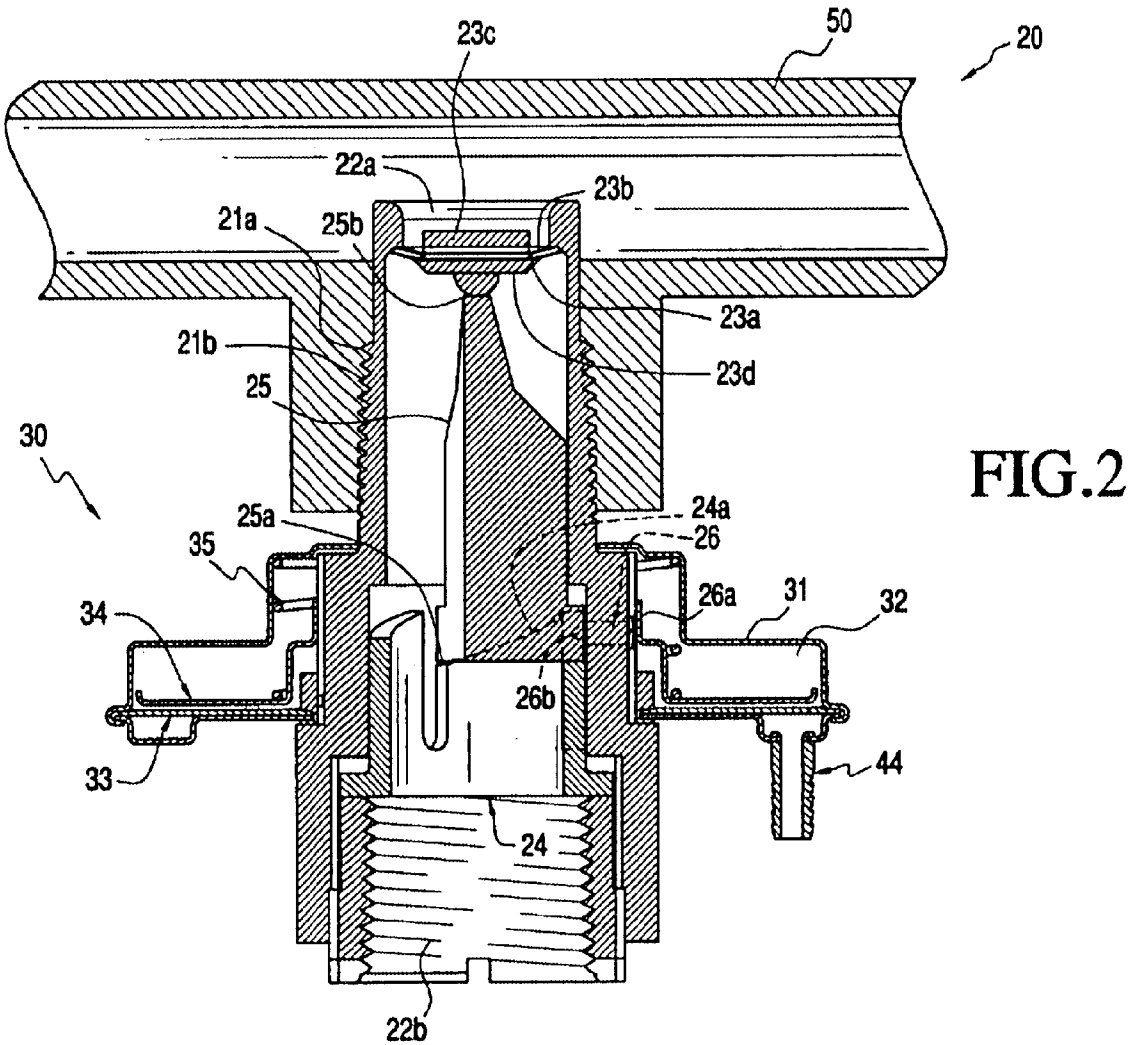
FIG. 2 is a cross-sectional view of a fluid control mechanism with the valve seal in the closed position in accordance with the first embodiment.
Figure 3:
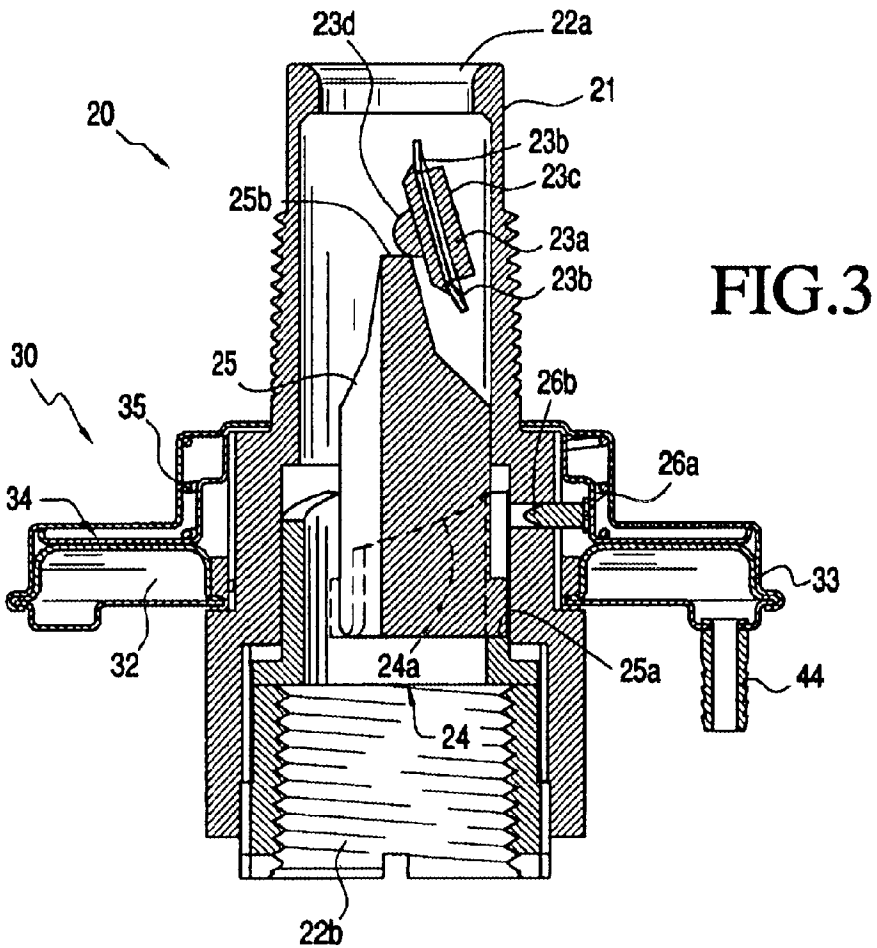
FIG. 3 is a cross-sectional view of a fluid control mechanism with the valve seal in the open position in accordance with the first embodiment.

As shown in FIG. 1, the dispensing mechanism 12, i.e., sprinkler head 12*a*, is connected to the conduit outlet 11*b* via a coupling such as a reducer 13. While a sprinkler head 12*a* is provided as the dispensing mechanism in accordance with the invention, it will become apparent to those skilled in the art that other mechanisms for dispensing a fluid such as nozzles or the like may be employed. Referring to FIGS. 1, 2 and 3, the assembly 10 also includes a fluid control apparatus including a valve assembly 20 for controlling fluid flow through the conduit 11. The fluid control apparatus is connected to a fluid source by way of a connector such as a T-branch 50, which establishes a transverse fluid flow path from the fluid source to the assembly 10. The valve assembly 20 has a valve body 21 defining a chamber 22 with an inlet 22*a* for receiving the fluid from a fluid source and an outlet 22*b* for discharging the fluid to the conduit 11. The valve body 21 is provided on the outer surface thereof with a plurality of threads 21*a* that cooperate with inner threads of the T-branch 50 to establish a connection point 21*b* between the valve body 21 and the fluid source, i.e., the T-branch 50. As defined here, the connection point 21*b* extends the entire length of the threaded connection between the valve body 21 and the T-branch 50.

Positioned at the valve inlet 22*a* and upstream of the dispensing mechanism 12 and conduit 11 is a valve seal 23 which is moveable between a closed position blocking fluid flow through the chamber 22, and thus, the conduit 11, and an open position permitting or causing fluid flow through the chamber 22 and the conduit 11. Accordingly, the sprinkler assembly 10 functions as an "ON" type assembly, i.e., the valve assembly 20 operates from a closed position to an open position such that once the valve seal 23 is in the open position, the valve seal 23 cannot return to the closed position regardless of any change in magnitude of the fire situation. When the valve body 21*a* is connected to the T-branch 50, the valve inlet 22*a* and the valve seal 23 protrude into the T-branch 50 so that the valve seal 23 is positioned upstream of the connection point 21*b*.

As shown in FIGS. 2 and 3, the valve seal 23 comprises a valve element 23*a* having a spring washer element 23*b* that seals the valve at the valve inlet 22*a* while in the closed position. Preferably, the washer element 23*b* is Teflon-coated to provide durability. When the valve seal 23 is in the closed position, an upper surface 23*c* of the seal 23 is exposed to the fluid while a lower surface 23*d* faces the chamber 22. The valve seal 23 is positioned in the closed position by a sealing force that maintains the valve seal 23 at the valve inlet 22*a* to prevent the flow of fluid to the conduit 11. The sealing force is applied to the valve seal 23 independent of the conduit 11 and the dispensing mechanism 12, i.e., the sprinkler head 12*a*. Accordingly, unlike many conventional dry sprinkler assemblies, which require sealing forces that are dependent upon a sprinkler head or nozzle and a length of pipe connected thereto, during installation of the assembly 10 in accordance with the present invention, the conduit 11 can be custom fit at any appropriate length in the field. This is advantageous since in reducing the overall installation costs and the time required for installation.

The spatial configuration, in particular, the axial distance between the opening end of the valve inlet 22*a* and the valve seal 23 is important since it minimizes the volume of the valve inlet 22*a*, and thus, unwanted fluid buildup at the upper surface 23*c* of the seal 23. Moreover, because the valve seal 23 is positioned upstream of the connection point 21*b*, and importantly, the valve inlet 22*a* and valve seal 23 each protrude into the transverse flow path of T-branch 50, excessive fluid accumulation at the upper surface 23*c* of the seal 23 is prevented. The sealing force placed on the valve seal 23 is advantageous since it prevents fluids and corrosion from entering the valve chamber 22 prematurely which may impede activation of the valve seal 23 if placed in area subject to freezing temperatures.

Located in the valve chamber 22 and positioned downstream of the valve inlet 22*a* and valve seal 23 is a valve operator. The valve operator includes a cam 24 having a cam surface 24*a* and a strut 25 axially disposed within the valve chamber 22. The strut 25 has a base 25*a* which is supported by the cam surface 24*a* for rotational and axial movement and a distal end 25*b* which movably supports the valve seal 23 into the closed position by applying the aforementioned sealing force.

The fluid control apparatus further includes an actuating mechanism including a valve actuator 30 which is operatively connected to the valve assembly 20 for moving the valve seal 23 to the open position upon release of the sealing force. As shown in FIG. 1, in relation to the conduit 11, the actuating mechanism 30 is positioned coaxially with respect to the valve assembly 20. In a less preferred embodiment of the invention, the actuating mechanism 30 may be positioned perpendicular with respect to both the conduit 11 and the valve assembly 20. Preferably, the actuator 30 is pneumatically operable, and thus, uses fluid pressure from a source to permit release of the sealing force to the valve seal 23. The valve actuator 30, however, may be a mechanical-type, an electric-type actuator including an electric motor and a gearing mechanism, or any type of actuator known in the art.

In accordance with the invention, the actuator 30 includes a housing 31 having a chamber 32 and an inlet adapted to receive a fluid, preferably, a gas such as air, nitrogen or like inert gases. The actuating mechanism 30 also includes a compliant diaphragm 33 which rests in a fluid flow path between a fluid source and the chamber 32, a piston element 34 positioned adjacent to the diaphragm 33, a locking member including an elongated pin member 26.

The diaphragm 33 is adapted for synchronous movement with the piston element 34 in response to fluid pressure received from the fluid source, the fluid pressure being associated with the heat emitted by a heat source. The elongated pin member 26 is adapted for movement relative to the valve body 21 between a locking position preventing the rotational and axial movement of the strut 25 and an unlocking position permitting the rotational and axial movement of the strut 25 to thereby release the sealing force from the valve seal 23. In essence, the pin member 26 in the locking position maintains the sealing force of the valve seal 23 while the unlocking position causes the release of the sealing force by the valve seal 23. The elongated pin member 26 has a basal surface 26*a* and a distal end 26*b* which enters into a hole or aperture in the cam 24 to engage the strut 25. The engagement between the distal end 26*b* of the pin 26 and the strut 25 serves to maintain the strut 25 in a fixed position relative to the cam surface 24*a*, and thus, prevents the downward axial rotation of the strut 25.

The piston 34 is disposed in the chamber 32 for synchronous movement with the diaphragm 33 between a first position maintaining the pin member 26 in the locked position and a second position causing or permitting the pin member 26 to move to the unlocked position. The piston 34 includes a surface 34*a* which abuts the base 26*a* of the pin member 26 to thereby prevent an outward movement of the pin member 26 relative to the valve body 21. A biasing mechanism 35 such as a spring or the like is also disposed in the chamber 32 for biasing the compliant diaphragm 33 and the piston 34 in the first position. This is achieved by applying a force which acts opposite to the fluid pressure placed on diaphragm 33 and the piston 34 when the valve seal 23 is positioned in the closed position. In operation, both the diaphragm 33 and piston 26 move upwardly in a synchronous manner to permit movement of the pin mechanism 26 to the unlocked position.

The assembly 10 also includes a sensing mechanism 40 operatively connected to the valve assembly 20. In accordance with the invention, the sensing mechanism 40 is in fluid communication and operatively connected to the actuating mechanism 30 and is thermodynamically responsive to heat emitted by the heat source. The sensing mechanism 40 is adapted to sense heat at either a fixed predetermined temperature or at a rate of rise in temperature. Although the sensing mechanism 40 senses heat, it should become apparent to one skilled in the art that such a definition does not exclude or prohibit the sensing of smoke or other non-heat qualities produced by the heat source. For instance, because smoke, as well as ultraviolet and infrared radiation, are by-products of a fire, the sensing mechanism 40 may also sense these variables in accordance with the present invention. In this regard, the sensing mechanism 40 may be thermodynamically responsive to at least one of heat, smoke, infrared radiation and ultraviolet radiation.

The sensing mechanism 40 includes a housing, such as a container or the like, adapted to be filled with a gas that expands in response to heat emitted by a heat source. In accordance with the invention, the gas in the housing may comprise at least one of air, nitrogen or like inert gases or combinations of gases. In accordance with the invention, the housing serves as a heat sink or collector, and thus, is adapted to transfer to the diaphragm 33 a fluid pressure associated with the heat emitted by the heat source. Preferably, the housing is composed of a material that is rigid and has a thermal conductivity that allows the sensing mechanism 40 to transfer heat received from a heat source to the gas contained therein. The sensing mechanism 40 may be formed in a variety of shapes, sizes and forms, depending upon its suitability to a particular application. Moreover, the sensing mechanism 40 can be formed as a relatively flat panel flush with the mounting surface, a donut-like shape that is sized to fit about the sprinkler head 12*a*.

The sensing mechanism 40 is preferably placed at a location within a region selected for optimum thermodynamic sensitivity and accuracy. Hence, not only is the dispensing mechanism 12, i.e., the sprinkler head 12*a*, positioned at an optimum location for effective fluid distribution, but the sensing mechanism 40 is also placed in an optimum position for thermodynamic sensitivity. For example, the sensing mechanism 40 may be mounted to a wall, ceiling, pipe section or directly to the sprinkler head 12*a*.

A coupling member 43 and a pair of tubular fittings 44 are provided for establishing a connection, such as a fluid flow path, between the sensing mechanism 40 and the actuating mechanism 30. Preferably, the coupling member 43 comprises a flexible element such as a length of tubing that permits the sensing mechanism 40 to be placed at a position for optimum thermodynamic sensitivity and response. As defined here, optimum thermodynamic sensitivity and response denotes the ability of the sensing mechanism 40 to respond to a fire situation. In this regard, while the sensing mechanism 40 of the first embodiment is coupled on the conduit 11 so as to lie adjacent to the sprinkler head 12*a*, the coupling member 43 may have a length that permits the sensing mechanism 40 to be located at any position that permits optimum thermodynamic sensitivity during a fire situation. It is also preferable that the coupling member 43 is composed of a flexible material that is capable of withstanding an environment subject to freezing temperatures and a high range of temperatures in which the sensing mechanism 40 will be exposed during a fire situation.

While the sensing mechanism 40 in accordance with the invention is shown operatively connected directly to the actuator 30 via the coupling 43, the sensing mechanism 40 may alternatively be connected to the actuator 30 using wireless technology so that the sensing mechanism 40 may be moved to any optimum location depending on room geometry, environmental conditions or other factors. This versatility allows the user to adapt the present invention to nearly any physical arrangement, giving consideration to the purpose for which the invention is intended.

An advantageous feature of the invention is that the valve assembly 20, i.e., the valve seal 23, remains in the open position irrespective of a magnitude of heat emitted by the heat source once said valve seal 23 moves into the open position in response to the predetermined temperature or the rate of rise in temperature being sensed by the sensing mechanism 40. Such an arrangement prevents fluid flow discharged by the dispensing mechanism 12 from prematurely shutting off fluid flow by contacting the sensing mechanism 40.

In operation, the sprinkler assembly 10 is placed in a location, such as a room, warehouse and the like of a commercial or home structure. During the event of a fire situation, the sensing mechanism 40 senses at least one of heat, smoke, ultraviolet radiation and infrared radiation produced by the source of the fire situation, i.e., the heat source. Because the sensing mechanism 40 serves as a heat sink, the rise in temperature of the housing causes the expansion of gas disposed therein, which, in turn, increases the fluid pressure inside the sensing mechanism 40. The expanding gas increases fluid pressure inside the housing so as to allow flow from the housing via the coupling member 43 to the valve actuator 30. Once received by the actuator 30, the fluid pressure associated with the expanding gases acts in a direction opposite to the force exerted by spring 35 on the diaphragm 33 and the piston 34. As the temperature produced by the heat source increases further, the fluid pressure increases considerably to overcome the spring force produced by the spring 35, thereby causing both the diaphragm 33 and piston 34 to synchronously move upwardly against the force of the spring 35.

Eventually, the fluid pressure exerted by the gas becomes so great that it causes the piston 34 to move upwardly to the second position, thereby causing the pin member 26 to move outwardly relative to the valve body 21 to the unlocked position. Once the pin member 26 is in the unlocked position, the strut 25 rotates axially in downward motion with respect to cam surface 24*a*, thereby releasing the sealing force that holds the valve seal 23 at the valve inlet 22*a*. The release of the sealing force causes the valve seal 23 to move into the open position to allow the flow of fluid through the valve body 21. Moreover, because the sprinkler assembly 10 functions as an "ON" type assembly, once the valve seal 23 is in the open position, it cannot return to the closed position regardless of any change in magnitude of the fire situation. This prevents premature shut-down of the valve assembly 20 due to the accidental cooling of the sensor mechanism 40 caused by contact of the fluid discharged by the dispensing mechanism 12.

Figure 4:
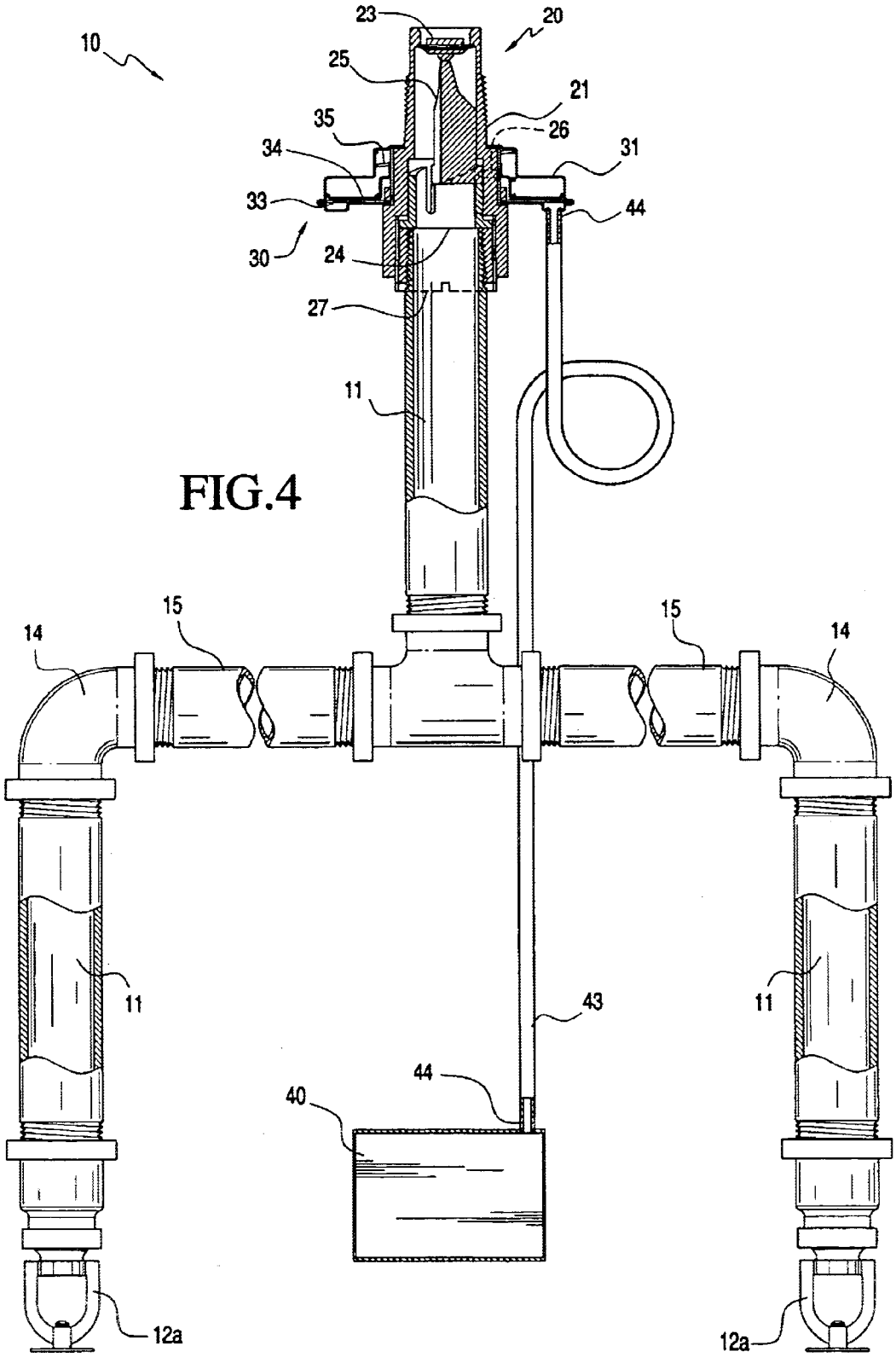
FIG. 4 is a planar view of the dry sprinkler system including a plurality of conduits in fluid communication with a pair of open sprinkler heads.

Although the dry sprinkler assembly 10 of the first embodiment is shown with a single fluid conduit 11 in communication with a single open sprinkler head 12*a*, the dry sprinkler assembly 10 is not limited to such a design and may encompass a plurality of conduits 11 and sprinkler heads 12*a*. As shown in FIG. 4, the dry sprinkler assembly 10 may comprise a sensing mechanism 40, coupling mechanisms 43, a fluid control apparatus, i.e., a valve assembly 20, an actuating mechanism 30, and a plurality of branch piping connected to a plurality of open sprinkler heads 12*a*. The branch piping includes at least one axial flow conduit 11, 15 and at least one transverse flow conduit 14, i.e., a pipe elbow, in fluid communication with the axial flow conduits 11, 15 and extending transverse therefrom. As defined here, a transverse flow conduit 14 denotes a conduit that extends at an angle at or less than ninety degrees relative to the axial flow conduit 11, 15. Accordingly, because the assembly 10 incorporates the use of various pipe fittings, the assembly 10 may be deployed in locales that require delivery of water by more than one sprinkler head. In addition, such a assembly 10 may be placed in locales having structures that require use of a combination of straight and bent pipes in order properly provide adequate fire sprinkler protection.

Figure 5:
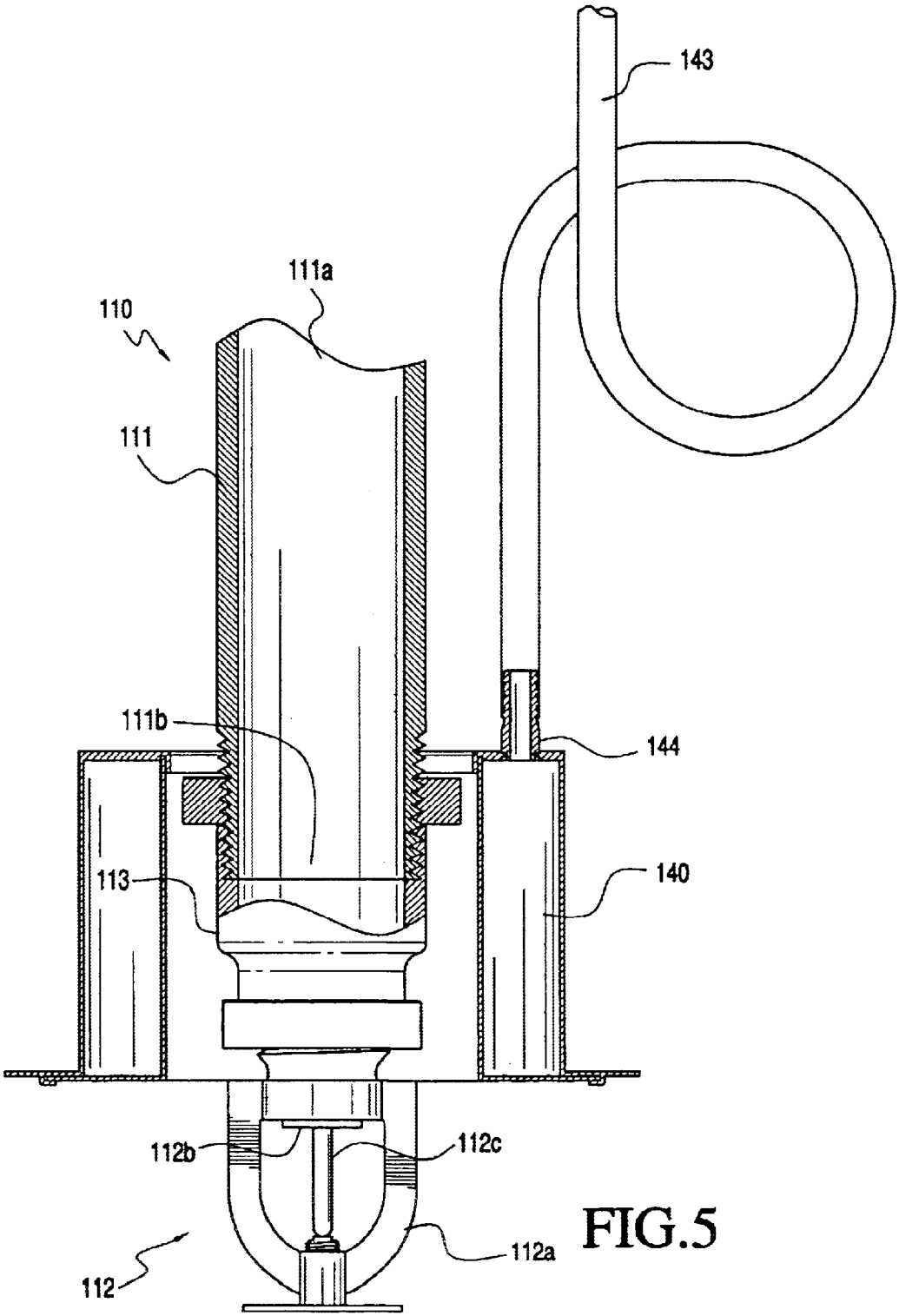
FIG. 5 is a planar view of a preaction dry sprinkler assembly in accordance with a second embodiment of the present invention.

FIG. 5 shows in accordance with a second embodiment of the invention a preaction dry sprinkler assembly 110 for controlling a fire situation. Because the components of the preaction dry sprinkler assembly 110 have substantially the same structure and functions substantially the same as the dry sprinkler assembly 10 of the first embodiment, no further explanation of these components is necessary. The assembly 110 includes at least one fluid conduit 111 defining a flow passage including an inlet 111*a* for receiving a fluid from a fluid source and an outlet 111*b* for discharging the fluid. The assembly 110 includes at least one fluid dispensing mechanism 112 such as an automatic sprinkler head 112*a* for distributing water to a selected location in a commercial or home structure. The dispensing mechanism 112, i.e., the automatic sprinkler head 112*a*, is connected to the conduit outlet 111*b* via a coupling such as a reducer 113.

The sprinkler head 112*a* includes a sprinkler head sealing mechanism for controlling fluid flow through the sprinkler head 112*a* and includes a seal element 112*b* located at the conduit outlet 111*b* and operable between a closed position blocking fluid flow through the sprinkler head 112*a* and an open position that allows fluid flow therethrough. The sprinkler head sealing mechanism also includes a sprinkler head actuator 112*c* for moving the seal element 112*b* in the open position in response to a predetermined condition, the sprinkler head actuator 112*c* being adapted to actuate the seal element 112*b* independent of the operation of the actuating mechanism (not shown). A coupling member 143 fluidically connects the sensing mechanism 140 to the actuating mechanism (not shown). While the sensing mechanism 140 of the second embodiment is axially positioned on the conduit 111 so that it is positioned adjacent the sprinkler head 112*a*, the coupling member 143 may have a length that permits the sensing mechanism 140 to be located at any position that permits optimum thermodynamic response in a fire situation.

Figure 6:
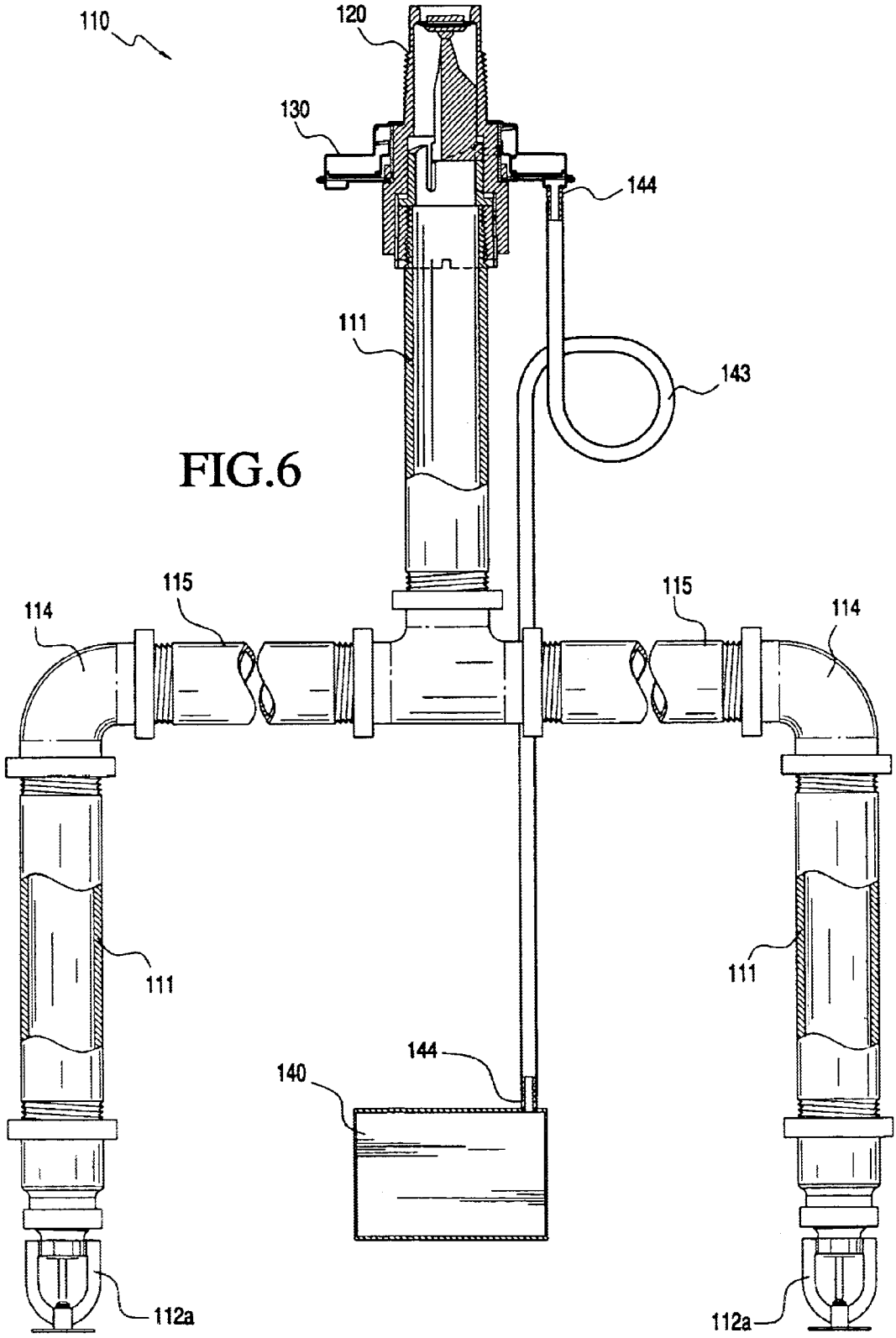
FIG. 6 is a planar view of the preaction dry sprinkler system including a plurality of conduits in fluid communication with a pair of automatic sprinkler heads.

Although the preaction dry sprinkler assembly 110 of the second embodiment is shown using a single fluid conduit 111 in communication with a single automatic sprinkler head 112*a*, the preaction dry sprinkler assembly 110 is not limited to such a design and may encompass a plurality of conduits 111 and sprinkler heads 112*a*. As shown in FIG. 6, the preaction dry sprinkler assembly 110 may comprise a sensing mechanism 140, a coupling mechanism 143, a fluid control apparatus, i.e., a valve assembly 120, an actuating mechanism 130, and a plurality of branch piping connected to a plurality of automatic sprinkler heads 112*a*. The branch piping may include at least one axial flow conduit 111, 115 and at least one transverse flow conduit 114, i.e., a pipe elbow, in fluid communication with the axial flow conduits 111, 115 and extending transverse therefrom. Accordingly, because the preaction dry sprinkler assembly 110 incorporates the use of various pipe fittings, the preaction dry sprinkler assembly 110 may be deployed in locales that require delivery of water by more than one sprinkler head. In addition, such a preaction dry sprinkler assembly 110 may be placed in locations having structures that require use of a combination of straight and bent pipes in order to provide adequate fire sprinkler protection.

Figure 7:
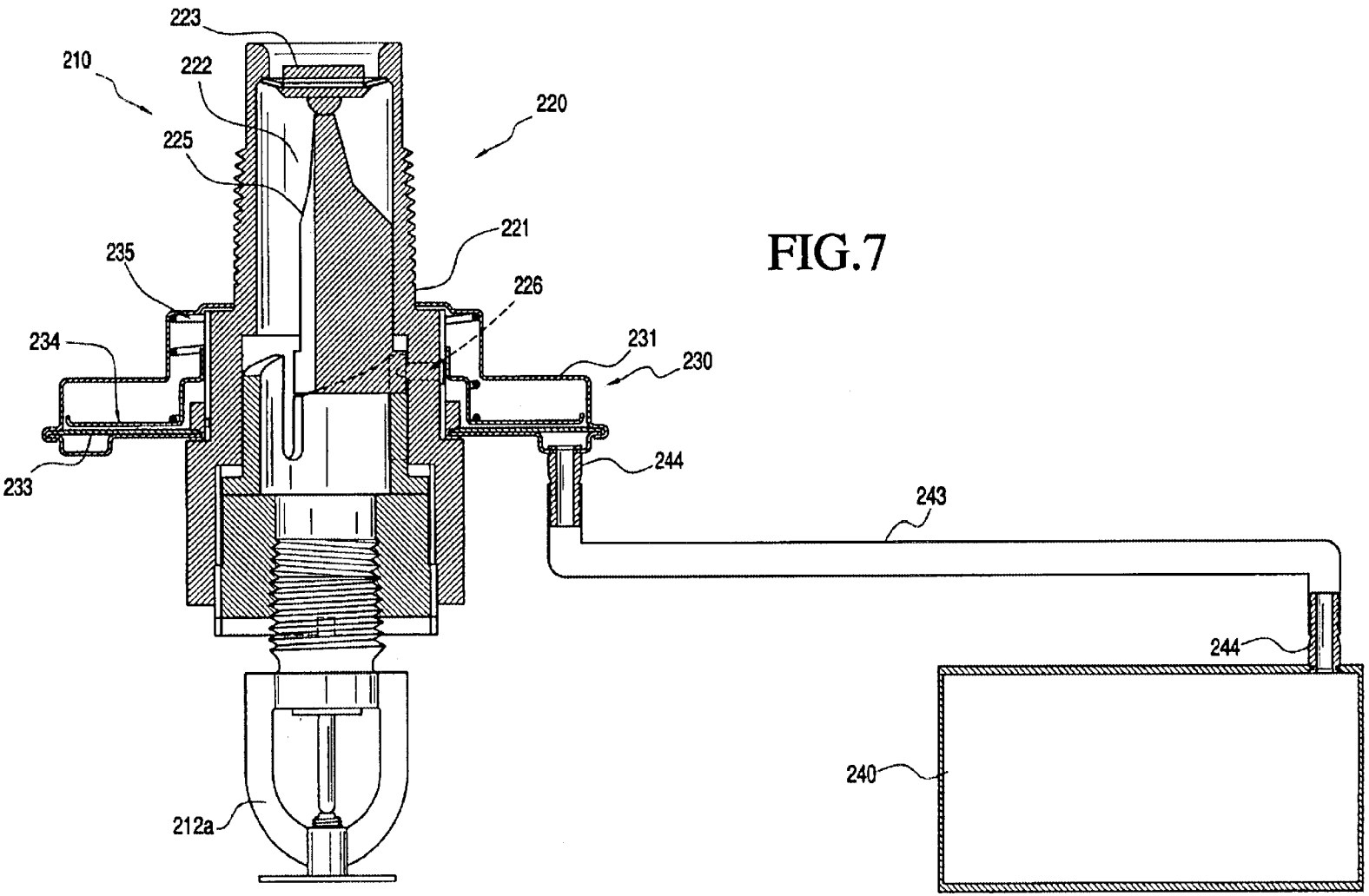
FIG. 7 is a planar view of a preaction dry sprinkler assembly in accordance with a third embodiment of the present invention.

FIG. 7, which shows another embodiment of a preaction dry sprinkler assembly 210 including an automatic sprinkler head directly connected to a fluid control assembly. Such a design is applicable in situations that have limited or no ceiling space in which to place a length of piping. The preaction dry sprinkler assembly 210 includes the same components described above, such as a fluid control apparatus including a valve assembly 220 having a valve body 221 defining a chamber 222 having an inlet for receiving the fluid and an outlet for discharging the fluid to a dispensing mechanism, i.e., an automatic sprinkler head 212*a*.

Also provided is a valve seal 223 positioned upstream of the sprinkler head 212*a* and moveable between a closed position blocking fluid flow through the chamber 222 and an open position permitting fluid flow through the chamber 222, and thus, the sprinkler head 212*a*. Accordingly, the valve assembly 220 operates from the closed position to the open position to provide a direct flow of water to the sprinkler head 212*a* in response to a fire situation. An actuating mechanism including a valve actuator 230 is operatively connected to the valve assembly 220 for causing movement of the valve seal 223 to the open position upon release of a sealing force that maintains the valve seal 223 in the closed position. The actuator 230 includes the same components previously described in the previous embodiments, such as a housing 231 adapted to receive a gas such as air, nitrogen or like inert gases. Disposed in the housing 231 is a compliant diaphragm 233 which is movable within the housing 231 in response to a fluid pressure received from the fluid source, the fluid pressure being associated with the heat emitted by a heat source.

A piston element 234 is also disposed in the housing 231 and is movably supported by the diaphragm 233 for movement between a first position maintaining a locking member 226 in a locked position and a second position permitting movement of the locking member 226 to an unlocked position. A biasing mechanism 235 such as a spring or the like is also disposed in the housing 231 for biasing the compliant diaphragm 233 and the piston 234 in a first position whereby applying a downward force which acts opposite to the fluid pressure placed on diaphragm 233 and the piston 234 when the valve seal 223 is positioned in the closed position. A coupling member 243 and a pair of tubular fittings 244 are provided for establishing a fluid flow path between a sensing mechanism 240 and the actuator housing 231. The coupling member 243 comprises a flexible element such as a length of tubing that permits the sensing mechanism 240 to be placed at a position for optimum thermodynamic response.

Figure 8:
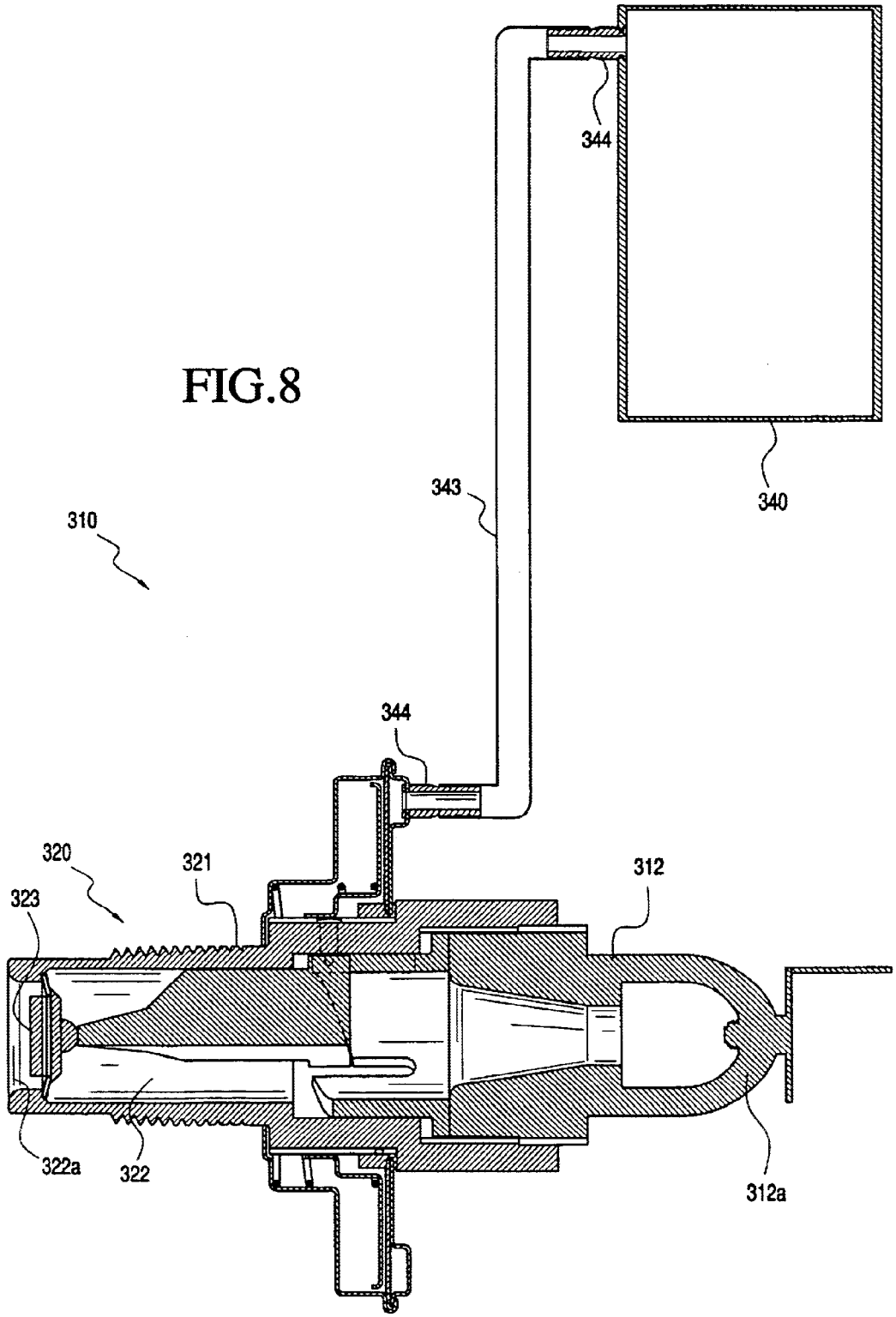
FIG. 8 is a cross-sectional view of a sprinkler assembly in accordance with a fourth embodiment of the present invention.

FIG. 8 shows another embodiment of a sprinkler assembly 310 for controlling a fire in either a heated environment or one which is subject to freezing temperatures. The sprinkler assembly 310 includes a dispensing and valve mechanism 320 in fluid communication with a fluid source for dispensing a fluid. The dispensing and valve mechanism 320 includes a dispensing and valve body 321 having a valve body section 322 and a dispensing body section 312 integrally connected. The valve body section 322 includes an inlet 322*a* for receiving the fluid while the dispensing body section 322 includes an outlet 312*a* for dispensing the fluid. The dispensing and valve mechanism 320 also includes a valve positioned upstream of the outlet 312*a* in the valve body section 322 for controlling flow of the fluid therethrough. The valve includes a valve element 323 moveable between a closed position blocking fluid flow to the dispensing body section 312 and an open position causing fluid flow through said dispensing and valve body.

A sensing mechanism 340 is operatively connected via coupling member 343 and connectors 344 to the dispensing and valve mechanism 320, specifically, the valve, and is thermodynamically responsive to at least one of heat, smoke, infrared radiation and ultraviolet radiation emitted by a heat source. The sensing mechanism 340 is moveable relative to said dispensing and valve mechanism to a position of optimum thermodynamic sensitivity. The assembly 310 operates generally in the same manner as the sprinkler assemblies previously described, and thus, no discussion is necessary.

An advantageous aspect associated with the sprinkler assembly in accordance with exemplary embodiments of the invention is the fact that the sprinkler assembly functions as an "ON" type assembly. In essence, the valve seal remains in the open position irrespective of a change in magnitude of heat emitted by the heat source once said valve seal moves into the open position in response to the sensor mechanism.

This prevents premature shut-down of the valve assembly due to a change in temperature of the location in which the sprinkler head is situated and which is caused by the discharge of fluid into the location.

Another advantageous aspect associated with the sprinkler assembly in accordance with exemplary embodiments of the invention is the spatial configuration between the valve inlet and the valve seal. Because the axial distance between the valve seal and the opening end of the valve inlet is of such a small distance, excessive fluid and corrosion accumulation are prevented from building at the surface of the valve seal.

Yet another advantageous aspect associated with the sprinkler assembly in accordance with exemplary embodiments of the invention is the spatial configuration between the valve seal, valve inlet and the fluid source. Because the valve seal and the valve inlet are positioned upstream of a connection point between the valve body and the fluid source, and an opening end of the valve inlet and the valve seal each protrude into the transverse flow path of the fluid source, excessive fluid accumulation at the upper face of the seal is prevented. This serves to prevent the development of an ice plug at the seal face that impedes flow through the valve if the assembly is placed in a location subject to freezing temperatures.

Still another advantageous aspect associated with the sprinkler assembly in accordance with exemplary embodiments of the invention is the sealing force placed on the valve seal to maintain the valve seal in a closed position. The sealing force prevents fluid from entering the valve chamber prematurely, thereby preventing activation of the valve seal if placed in an area subject to freezing temperatures.

Yet another advantageous aspect associated with the sprinkler assembly in accordance with exemplary embodiments of the invention is the sealing force is applied to the valve seal independent from the dispensing mechanism and the fluid conduit connected thereto. Consequently, the fluid conduit can be custom fit at any appropriate length in the field and the assembly may incorporate various pipe fittings which enable installation of the assembly in structures that require the usage of a combination of straight and bent piping.

Yet a further advantageous aspect associated with the sprinkler assembly in accordance with exemplary embodiments of the invention is the adaptability of the sensing mechanism to be placed at a location selected for optimum thermodynamic sensitivity and accuracy in response to a fire situation. Hence, the sensing mechanism may be spatially situated away from the dispensing mechanism, i.e., the sprinkler head, in an optimum position for thermodynamic sensitivity in response to a fire situation.

While the foregoing components have been shown and described with reference to a particular material construction, it is understood by those skilled in the art that any suitable non-corrosive material, including polymeric materials, alloys or the like may be used giving consideration to the purpose for which the present invention is intended. Although the present invention is shown and described in connection with a horizontal plurality of pipes that distribute fluid to equidistant sprinkler heads, those skilled in the art will appreciate that the conduits and its components may be arranged in any suitable configuration, with any number of pipe sections, pipe or network geometries, branches and sprinkler heads, giving consideration to the purpose for which the present invention is intended.

What is claimed is:

1. A sprinkler assembly for controlling a fire comprising:

at least one fluid conduit defining a flow passage including an inlet for receiving a fluid from a fluid source and at least one conduit outlet for discharging the fluid;

at least one dispensing mechanism in fluid communication with said at least one conduit outlet for dispensing the fluid received from said at least one fluid conduit;

a valve assembly for controlling flow of the fluid through said at least one fluid conduit and adapted for connection between the fluid source and said at least one fluid conduit, said valve assembly including a valve inlet for receiving the fluid and a valve seal positioned upstream of said conduit inlet, said valve seal being moveable between a closed position blocking fluid flow through said at least one fluid conduit and an open position permitting fluid flow through said at least one fluid conduit, said valve seal being maintained in said closed position by a sealing force, said sealing force being applied to said valve seal independent from said dispensing mechanism and said at least one fluid conduit;

a sensing mechanism operatively connected to said valve assembly, said sensing mechanism being thermodynamically responsive to at least one of heat, smoke, infrared radiation and ultraviolet radiation emitted by a heat source, and an actuating mechanism operatively connected to said sensing mechanism and said valve assembly for permitting movement of said valve seal to said open position in response to said sensing mechanism, wherein said valve seal remains in said open position irrespective of a magnitude of said at least one of heat, smoke, infrared radiation and ultraviolet radiation emitted by the heat source once said valve seal moves into said open position by said actuating mechanism in response to said sensing mechanism.

2. The assembly according to claim 1, wherein said sensing mechanism is moveable relative to said valve assembly to a position for optimum thermodynamic sensitivity in response to a fire situation.

3. The assembly according to claim 2, wherein said at least one dispensing mechanism comprises a body adapted to discharge a predetermined spray pattern of fluid.

4. The assembly according to claim 3, wherein said at least one dispensing mechanism comprises a seal element movable between a closed position blocking fluid flow through said at least one dispensing mechanism and an open position permitting fluid flow through said at least one dispensing mechanism, and a dispensing mechanism actuating mechanism for permitting movement of said seal element to said open position in response to a predetermined condition.

5. The assembly according to claim 3, wherein said valve assembly is connected to the fluid source at a connection point, said valve seal and an opening end of said valve inlet being positioned upstream of said connection point so as to protrude into a transverse flow path of the said source to thereby prevent excessive fluid accumulation at said valve seal.

6. The assembly according to claim 5, wherein said at least one dispensing mechanism comprises a seal element movable between a closed position blocking fluid flow through said at least one dispensing mechanism and an open position permitting fluid flow through said at least one dispensing mechanism, and a dispensing mechanism actuating mechanism for permitting said seal element to move to said open position in response to a predetermined condition.

7. A sprinkler system for controlling a fire comprising:

a plurality of fluid conduits which define a flow passage including a conduit inlet for receiving a fluid from a fluid source and a plurality of conduit outlets for discharging the fluid;

a plurality of dispensing mechanisms each in fluid communication with each of said plurality of conduit outlets, respectively, for dispensing the fluid received from said plurality of fluid conduits;

a sprinkler valve assembly for controlling fluid flow through said plurality of fluid conduits and adapted for connection between the fluid source and said plurality of fluid conduits, said sprinkler valve assembly including a valve inlet for receiving the fluid and a valve seal positioned upstream of said conduit inlet and moveable between a closed position blocking fluid flow through said plurality of conduits and an open position permitting fluid flow through said plurality of fluid conduits, said valve seal being maintained in said closed position by a sealing force applied to said valve seal independent from said plurality of dispensing mechanisms and said plurality of fluid conduits;

a sensing mechanism operatively connected to said valve assembly, said sensing mechanism being thermodynamically responsive to at least one of heat, smoke, infrared radiation and ultraviolet radiation emitted by a heat source; and an actuating mechanism operatively connected to said sensing mechanism and said sprinkler valve assembly for permitting movement of said valve seal to said open position in response to said sensing mechanism, wherein said plurality of fluid conduits includes at least one axial flow conduit and at least one transverse flow conduit in fluid communication with said at least one axial flow conduit.

8. The system according to claim 7, wherein said sensing mechanism is moveable relative to said valve assembly to a position of optimum thermodynamic sensitivity in response to a fire situation.

9. The system according to claim 8, wherein said plurality of dispensing mechanisms comprise a body adapted to discharge a predetermined spray pattern of fluid.

10. The system according to claim 9, wherein said sprinkler valve assembly is connected to the fluid source at a connection point, said valve seal and an opening end of said valve inlet being positioned upstream of said connection point so as to protrude into a transverse flow path of the fluid source to thereby prevent excessive fluid accumulation at said valve seal.

11. A sprinkler valve assembly for connection to at least one dispensing mechanism for controlling a fire situation, said sprinkler valve assembly comprising:

a valve body including a valve inlet for receiving a fluid from a fluid source, said valve body being adapted for connection to the fluid source;

a valve seal moveable between a closed position blocking fluid flow through said valve body and an open position permitting fluid flow through said valve body, said valve seal being maintained in said closed position by a sealing force, said sealing force being applied to said valve seal independent from the at least one dispensing mechanism; and a sensing mechanism operatively connected to said valve assembly, said sensing mechanism being thermodynamically responsive to at least one of heat, smoke, infrared radiation and ultraviolet radiation emitted by a heat source, an actuating mechanism operatively connected to said sensing mechanism and said valve assembly for permitting movement of said valve seal to said open position in response to said sensing mechanism, wherein said valve seal remains in said open position after said actuating mechanism permits movement of said valve seal into said open position.

12. The assembly according to claim 11, wherein said valve body is connected to the fluid source at a connection point, said valve seal and an opening end of said valve inlet being positioned upstream of said connection point so as to protrude into a transverse flow path of the fluid source and thereby prevent excessive fluid accumulation at said valve seal.

13. The assembly according to claim 11, wherein said sensing mechanism is moveable relative to said valve assembly to a position of optimum thermodynamic sensitivity in response to a fire situation.

14. The assembly according to claim 13, wherein said valve body is connected to the fluid source at a connection point, said valve seal and an opening end of said valve inlet being positioned upstream of said connection point so as to protrude into a transverse flow path of the fluid source and thereby prevent excessive fluid accumulation at said valve seal.

15. A sprinkler valve assembly for connection to at least one dispensing mechanism for controlling a fire situation, said sprinkler valve assembly comprising:

a valve body including a valve inlet adapted for connection to a fluid source at a connection point;

a valve seal moveable between a closed position blocking said flow through said valve body and an open position permitting fluid flow through said valve body, said valve seal being maintained in said closed position by a sealing force, said sealing force being applied to said valve seal independent from the at least one dispensing mechanism; and a sensing mechanism operatively connected to said valve assembly, said sensing mechanism being thermodynamically responsive to at least one of heat, smoke, infrared radiation and ultraviolet radiation emitted by a heat source, an actuating mechanism operatively connected to said sensing mechanism, and said valve assembly for permitting movement of said valve seal to said open position in response to said sensing mechanism, wherein said valve seal and an opening end of said valve inlet are positioned upstream of said connection point so as to protrude into a verse flow path of the fluid source and thereby prevent excessive fluid accumulation at said valve seal.

16. The assembly according to claim 15, wherein said valve seal remains in said open position after said actuating mechanism permits movement of said valve seal into said open position.

17. The assembly according claim 15, wherein said sensing mechanism is moveable relative to said valve assembly to a position of optimum thermodynamic sensitivity in response to a fire situation.

18. The assembly according to claim 17, wherein said valve seal remains in said open position after said actuating mechanism permits movement of said valve seal into said open position.

19. A sprinkler valve assembly for connection to at least one dispensing mechanism for controlling a fire situation, said sprinkler valve assembly comprising:

a valve body including a valve inlet adapted for connection to a fluid source;

a valve seal moveable between a closed position blocking fluid flow through said valve body and an open position permitting fluid flow through said valve body, said valve seal being maintained in said closed position by a sealing force, said sealing force being applied to said valve seal independent on the at least one dispensing mechanism;

a sensing mechanism operatively connected to said valve assembly, said sensing mechanism being thermodynamically responsive to at least one of heat, smoke, infrared radiation and ultraviolet radiation emitted by a heat source, and an actuating mechanism operatively connected to said sensing mechanism and said sprinkler valve assembly for permitting movement of said valve seal to said open position in response to said sensing mechanism, wherein said valve seal remains in said open position irrespective of a magnitude of said at least one of heat, smoke, infrared radiation and ultraviolet radiation emitted by the heat source once said valve seal moves into said open position by said actuating mechanism in response to said sensing mechanism.

20. The assembly according to claim 19, where said valve assembly further comprises a valve operator positioned within said valve body downstream of said valve seal.

21. The assembly according to claim 20, wherein said valve operator comprises a cain including a cam surface and a strut supported by said cam surface for rotational and axial movement, said strut having a distal end which applies said sealing force to said valve seal.

22. The system according to claim 19, wherein said actuating mechanism is pneumatically operable using fluid pressure received from said sensing mechanism to control application of said sealing force, said fluid pressure being associated with said at least one of heat, smoke, infrared radiation and ultraviolet radiation emitted by the heat source.

23. The system according to claim 22, wherein said actuating mechanism comprises a housing having an inlet for receiving a fluid pressure, a compliant diaphragm disposed within said housing, a piston element positioned adjacent to said diaphragm, and a locking member adapted for movement between a locked position maintaining said sealing force and an unlocked position releasing said sealing force.

24. The system according to claim 23, wherein said piston element is adapted for synchronous movement with said compliant diaphragm between a first position maintaining said locking member in said locked position and a second position permitting movement of said locking member to said unlocked position.

25. The system according to claim 24, wherein said compliant diaphragm is adapted for movement in response to said fluid pressure received from said sensing mechanism.

26. The system according to claim 25, wherein said actuating mechanism further comprises a biasing mechanism for applying a force which maintains said piston element in said first position.

27. The system according to claim 26, wherein said force exerted by said bias mechanism acts in a direction which is counter to said fluid pressure.

28. The system according to claim 19, further comprising a coupling member for establishing connection between said sensing mechanism and said actuating mechanism.

29. The system according to claim 28, wherein said coupling member comprises a flexible element having a length permitting movement of said sensing mechanism relative to said valve assembly at a position of optimum thermodynamic sensitivity in response to a fire situation.

30. The system according to claim 19, wherein said sensing mechanism is moveable relative to said valve assembly to a position for optimum thermodynamic sensitivity.

31. The system according to claim 30, wherein said sensing mechanism comprises a housing in fluid communication with said actuating mechanism, said housing containing a gas that expands in response to heat emitted by the heat source.

32. The system according to claim 31, wherein said sensing mechanism is adapted to transfer a fluid pressure, said fluid pressure being associated with the expansion of the gas in said sensing mechanism.

33. The system according to claim 19, wherein said at least one dispensing mechanism comprises an open sprinkler head.

34. The assembly according to claim 19, wherein said valve body is connected to the fluid source at a connection point, said valve seal and an opening end of said valve inlet being positioned upstream of said connection point so as to protrude into a transverse flow path of the fluid source and thereby prevent excessive fluid accumulation at said valve seal.

* * * * *

UNITED STATES PATENT AND TRADEMARK OFFICE

CERTIFICATE OF CORRECTION

PATENT NO. : 6,851,482 B2
APPLICATION NO. : 09/985039
DATED : February 8, 2005
INVENTOR(S) : Kevin Michael Dolan It is certified that error appears in the above-identified patent and that said Letters Patent is hereby corrected as shown below:

Add original claims:
Col. 18, line 37, insert

--35. The system according to claim 9, wherein at least one of said plurality of dispensing mechanisms comprises a seal element movable between a closed position blocking fluid flow through said at least one dispensing mechanism and an open position permitting fluid flow through said at least one dispensing mechanism, and a dispensing mechanism actuating mechanism for permitting movement of said seal element to said open position in response to a predetermined condition.

36. The system according to claim 10, wherein at least one of said plurality of dispensing mechanisms comprises a seal element movable between a closed position blocking fluid flow through said at least one dispensing mechanism and an open position permitting fluid flow through said at least one dispensing mechanism, and a dispensing mechanism actuating mechanism for permitting movement of said seal element to said open position in response to a predetermined condition.

37. The system according to claim 19, wherein said at least one dispensing mechanism comprises a seal element moveable between an closed position blocking fluid flow through said at least one dispensing mechanism and an open position permitting fluid flow through said at least one dispensing mechanism, and a dispensing mechanism actuating mechanism for permitting said seal element to move to said open position in response to a predetermined condition.

38. The system according to claim 37, wherein said dispensing mechanism actuating mechanism adapted to actuate said seal element independent of the operation of said actuating mechanism.

39. The system according to claim 38, wherein said at least one dispensing mechanism comprises an automatic sprinkler head.

UNITED STATES PATENT AND TRADEMARK OFFICE

CERTIFICATE OF CORRECTION

PATENT NO. : 6,851,482 B2
APPLICATION NO. : 09/985039
DATED : February 8, 2005
INVENTOR(S) : Kevin Michael Dolan It is certified that error appears in the above-identified patent and that said Letters Patent is hereby corrected as shown below:

40. The system according to claim 19, wherein said at least one fluid conduit comprises a plurality of fluid conduits, said plurality of fluid conduits including at least one axial flow conduit and at least one transverse flow conduit in fluid communication with said axial flow conduit.--

Signed and Sealed this

Third Day of June, 2008

JON W. DUDAS
*Director of the United States Patent and Trademark Office*